US011154895B2

(12) United States Patent
Zhu et al.

(10) Patent No.: US 11,154,895 B2
(45) Date of Patent: Oct. 26, 2021

(54) SHOWER HEAD WITH HOLDER DEVICE

(71) Applicant: Xiamen Rainshower Co. Ltd., Xiamen (CN)

(72) Inventors: Binghuo Zhu, Xiamen (CN); Hewei Liu, Xiamen (CN); Kunjing Fan, Xiamen (CN)

(73) Assignee: Xiamen Rainshower Co. Ltd., Xiamen (CN)

( * ) Notice: Subject to any disclaimer, the term of this patent is extended or adjusted under 35 U.S.C. 154(b) by 0 days.

(21) Appl. No.: 16/747,920

(22) Filed: Jan. 21, 2020

(65) Prior Publication Data

US 2021/0008584 A1 Jan. 14, 2021

(30) Foreign Application Priority Data

Jul. 12, 2019 (CN) ..... 201910629793.6

(51) Int. Cl.

| | |
|---|---|
| ***B05B 15/65*** | (2018.01) |
| ***B05B 15/63*** | (2018.01) |
| ***B05B 1/18*** | (2006.01) |
| ***B05B 12/00*** | (2018.01) |
| ***B05B 9/01*** | (2006.01) |
| ***B05B 1/16*** | (2006.01) |
| ***B05B 1/30*** | (2006.01) |

(52) U.S. Cl.

CPC ..... *B05B 15/65* (2018.02); *B05B 1/16* (2013.01); *B05B 1/1627* (2013.01); *B05B 1/1636* (2013.01); *B05B 1/1681* (2013.01); *B05B 1/185* (2013.01); *B05B 1/3026* (2013.01); *B05B 9/01* (2013.01); *B05B 12/002* (2013.01); *B05B 15/63* (2018.02)

(58) Field of Classification Search

CPC ..... B05B 15/65; B05B 15/63; B05B 1/185; B05B 12/002; B05B 1/3026; B05B 9/01; B05B 1/1627; B05B 1/1636; B05B 1/16; B05B 1/1681

USPC ..... 239/525, 530, 443–449, 588, 581.1, 239/587.1, 587.4, 600; 4/605

See application file for complete search history.

(56) References Cited

U.S. PATENT DOCUMENTS

| | | | | |
|---|---|---|---|---|
| 2,949,240 A * | 8/1960 | Koolnis | ..... | B05B 1/18 239/600 |
| 4,752,975 A * | 6/1988 | Yates | ..... | E03C 1/06 4/605 |
| 4,914,759 A * | 4/1990 | Goff | ..... | E03C 1/06 239/530 |
| 6,618,872 B1 * | 9/2003 | Fan | ..... | B05B 1/1618 239/444 |

(Continued)

*Primary Examiner* — Steven J Ganey

(74) *Attorney, Agent, or Firm* — Bayramoglu Law Offices LLC

(57) ABSTRACT

The present invention provides a shower head with a holder device, comprising a shower head and a water inlet; wherein the shower head comprises a housing, a water outlet disc, and a water diversion mechanism; a handle extends horizontally on one side of the housing, a water outlet is provided on the side of the handle, and a socket for holding a handheld shower is fixedly connected to the end of the handle; The present invention makes the stress center of gravity of the overall shower component closer to the extension line of the water inlet end, which can avoid the deflection of the shower head of the handheld shower and it is more convenient to take and place the handheld shower.

10 Claims, 11 Drawing Sheets

(56) References Cited

U.S. PATENT DOCUMENTS

| | | | | |
|---|---|---|---|---|
| 7,143,961 | B1 * | 12/2006 | Wu | E03C 1/0408 239/446 |
| 8,066,204 | B2 * | 11/2011 | Petrovic | B05B 1/1609 239/447 |
| 9,631,348 | B2 * | 4/2017 | Huang | B05B 1/1636 |
| 2006/0242759 | A1 | 11/2006 | Tsai | |
| 2017/0173603 | A1 | 6/2017 | Lin et al. | |

* cited by examiner

Prior Art

Prior Art

SHOWER HEAD WITH HOLDER DEVICE

CROSS REFERENCE TO RELATED APPLICATIONS

This application is based upon and claims priority to Chinese Patent Application No. 201910629793.6, filed on Jul. 12, 2019, the entire contents of which are incorporated herein by reference.

TECHNICAL FIELD

The present invention relates to a shower component, in particular to a shower head with a socket for handheld shower.

BACKGROUND

The conventional shower head and holder device (socket for handheld shower) are in a split design, that is, the holder device is directly installed on the wall, and then the handheld shower is placed on the holder device. In this way, an additional holder device needs to be installed on the wall, which increases the difficulty of installation. In view of the above problems, the industry has developed a "Holder device for shower head and nozzle" (US2006/0242759A1). As shown in FIGS. 1 and 2, the supporting structure 1*a* has a three-way base 10*a*, the base 10*a* is coaxially provided with a water outlet pipe 90*a* and a shower head 20*a* in the X-axis direction, and is coaxially provided with a holder device 24*a* and a waterway switching knob 50*a* in the Y-axis direction perpendicular to the X axis. This structure solves the technical problem that an additional holder device needs to be installed on the wall. However, the waterway switching knob 50*a* is provided at the rear end of the shower head 20*a*, which causes the hand to be operated at the rear end of the shower head 20*a* when switching the waterway, which increases the difficulty of operation; at the same time, when the handheld shower 22*a* is placed on the holder device 24*a*, the center of gravity of the overall support structure 1*a* is biased towards the side of the handheld shower 22*a*. As long as it is used for a period of time, the support structure 1*a* will gradually deflect to the side of the holder device 24*a*.

As shown in FIG. 3, another practitioner has developed another "Remote switch combination shower head" (US2017/0173603A1). By adding a V-shaped fixing base 10*b*, the shower head 20*b* and the handheld shower 30*b* are provided therein without drilling. The waterway switching component 40*b* of this structure and the operating member 41*b* are provided separately, and the V-shaped fixing base 10*b* needs to be provided with an internal waterway to supply water to the shower head 20*b*. The above design makes the overall structure too bloated and complicated in structure, and the manufacturing cost is high.

SUMMARY

The present invention aims to solve the technical problems in the above technology at least to a certain extent. Therefore, an object of the present invention is to provide a shower head with a holder device.

In order to achieve the above object, the present application proposes a shower head with a holder device, comprising a housing, a water outlet disc, a water inlet and a water diversion mechanism, wherein a handle extends horizontally on one side of the housing, at least a water outlet is provided on the radial end of the handle, and a socket for holding a handheld shower is connected to the axial end of the handle; a water inlet is provided at the top of the housing on a side close to the handle; the water diversion mechanism is provided inside the handle, the water diversion mechanism comprises a valve seat and a valve core; the valve seat has a water inlet channel (x), a first water outlet channel (y) and a second water outlet channel (z) which are communicated with the water inlet, the first water outlet channel (y) and the water outlet are communicated with each other, the second water outlet channel (z) and the water outlet disc of the shower head are communicated with each other; the water inlet channel (x), the first water outlet channel (y) and the second water outlet channel (z) have a waterway pooling area, the valve core is provided in the waterway pooling area, a knob is fixedly connected to the end of the valve core, the knob is provided on the end surface of the handle facing the side of the user, and the valve core is driven to rotate by the knob so as to realize waterway switching arrangement of the water inlet channel (x), the first water outlet channel (y) and the second water outlet channel (z).

Based on the above design: because the socket and the shower head are provided along the left and right sides of the handle of the housing, respectively, and the eccentric design that the water inlet at the top of the housing of the shower head is located at the water outlet end of the shower head, the center of gravity of the overall shower component (the shower head+the handheld shower) is closer to the extension line of the water inlet of the housing, which can prevent the shower component from deflecting toward the side of the handheld shower when the handheld shower is placed on the socket; and because the socket is provided on the same side of the water outlet end surface of the shower head, it is convenient for the people to take and place the handheld shower; at the same time, the waterway switching knob is also provided on the water outlet end surface of the shower head, which is convenient for the people to switch the waterway of the shower head or the handheld shower.

DESCRIPTION OF THE EMBODIMENTS

Figure 1:
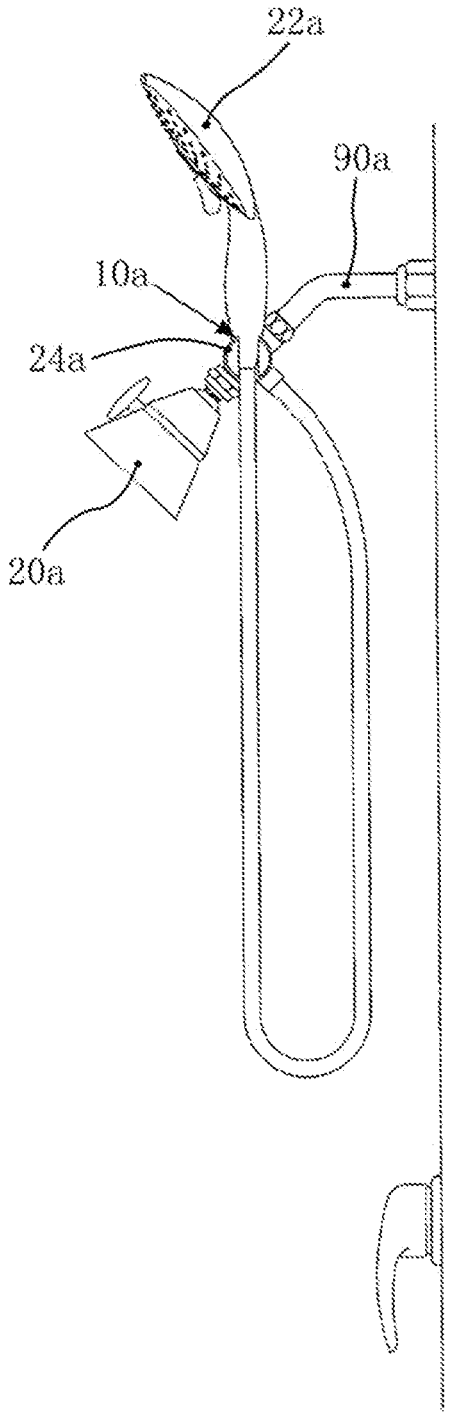
FIG. 1 is a schematic diagram of a state of use of a first conventional shower head with a socket in which a handheld shower is inserted.
Figure 2:
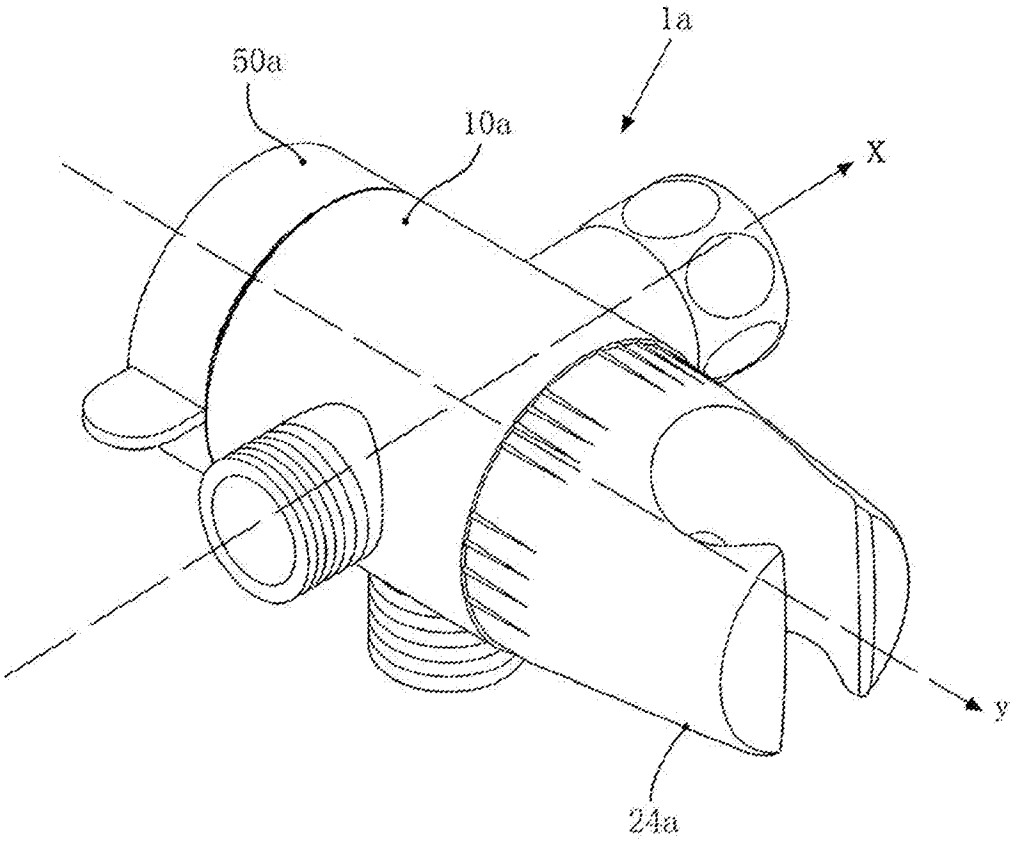
FIG.2 Prior Art
FIG. 2 is a perspective diagram of a conventional three-way fixing base.
Figure 3:
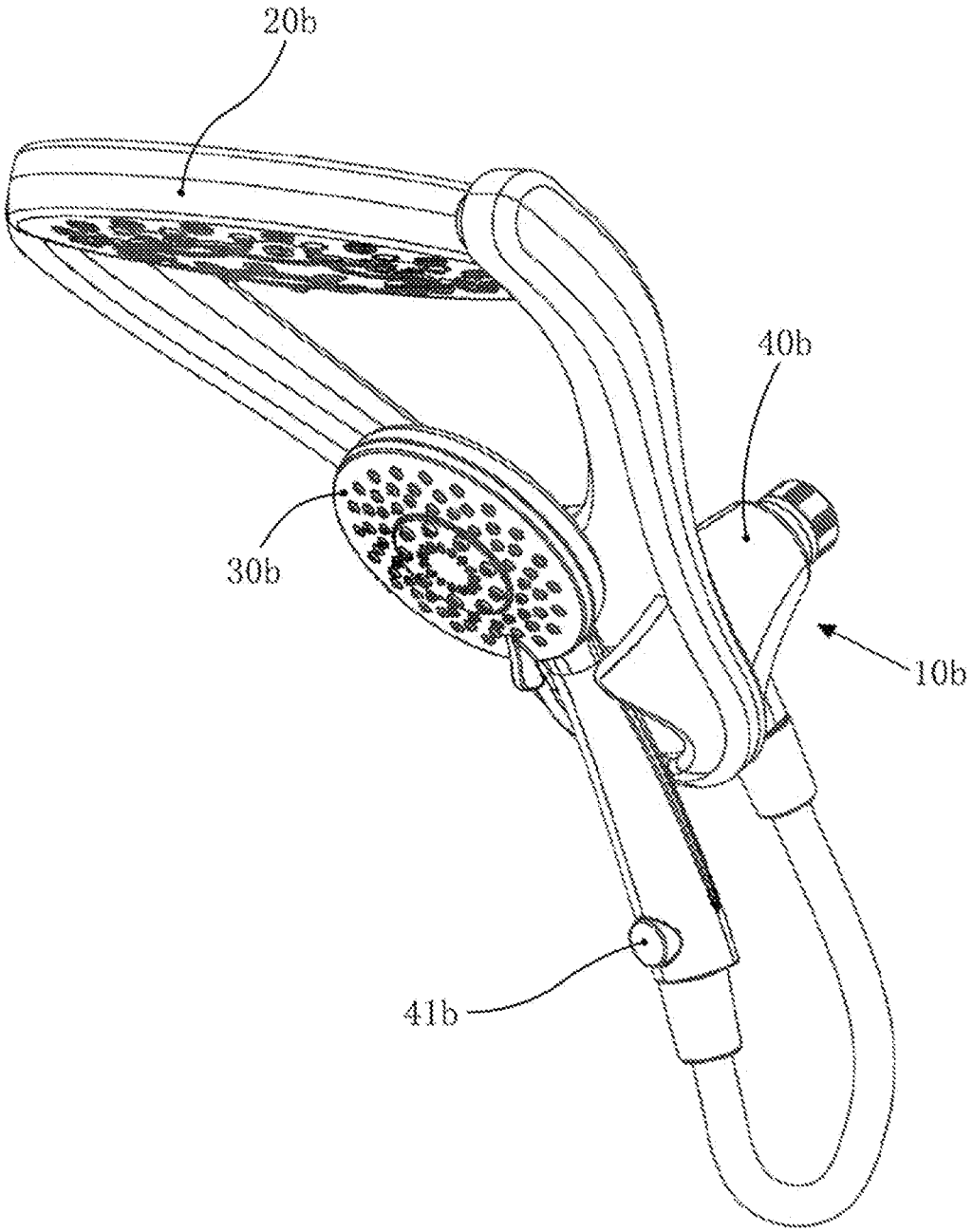
FIG. 3 is a schematic diagram showing a state of use of a second conventional shower head with a socket in which a handheld shower is inserted.
Figure 4:
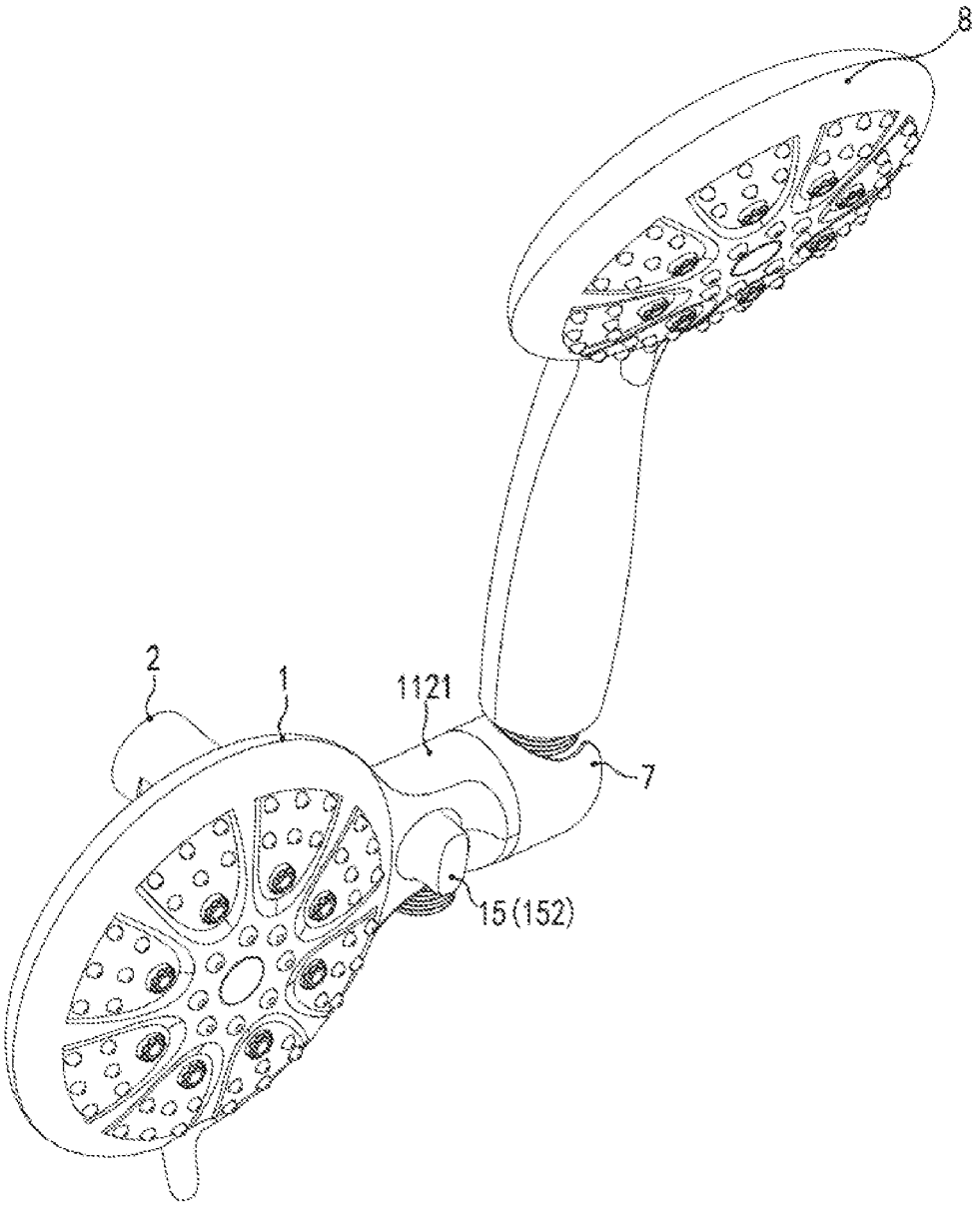
FIG. 4 is a schematic diagram of a state of use of a shower head with a socket in which a handheld shower is inserted according to the present invention.
Figure 5:
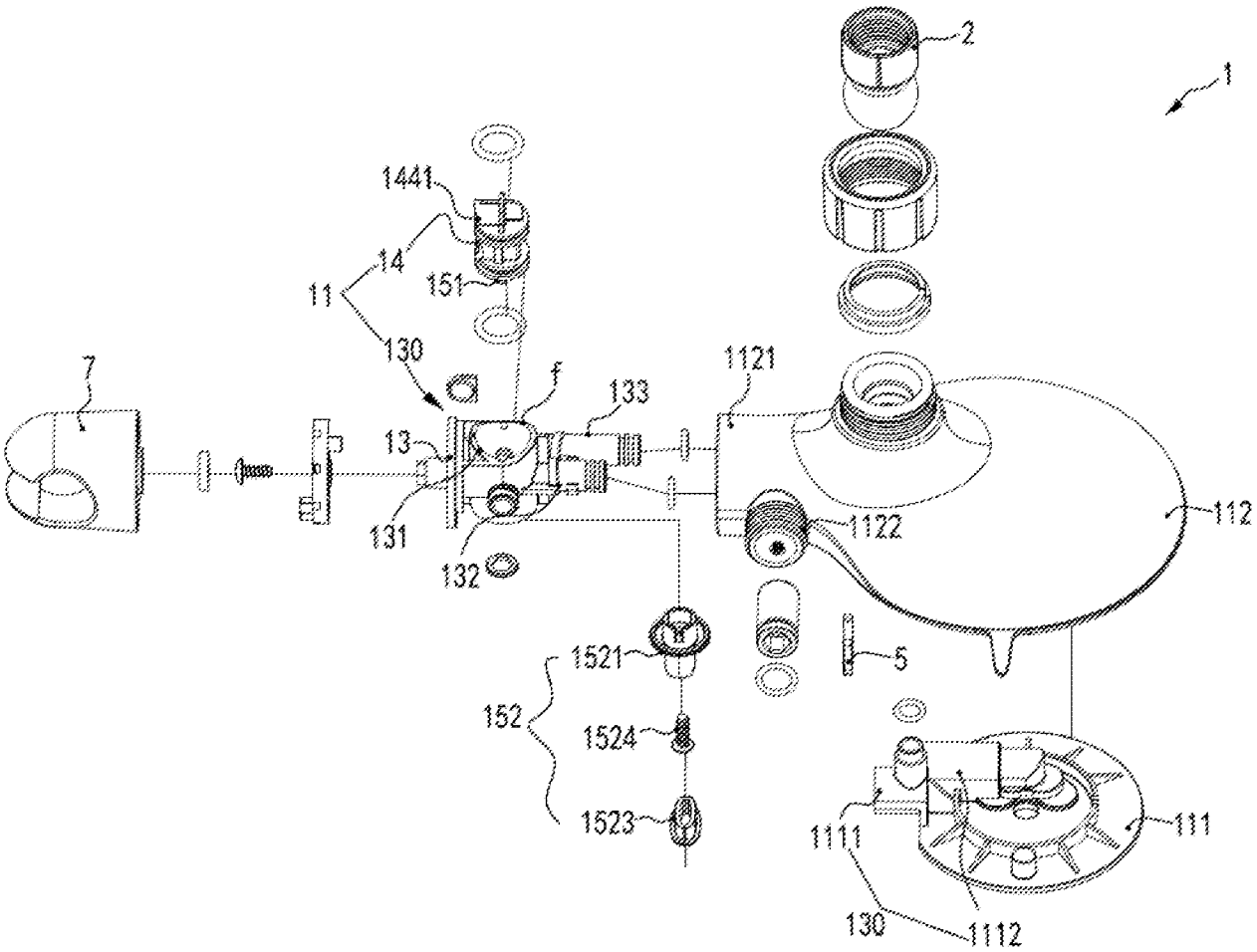
FIG. 5 is an exploded diagram of a shower head with a socket according to the present invention.

Refer to FIG. 4 and FIG. 5, a shower head with a holder device comprises a shower head 1 and a water inlet 2, and the water inlet 2 is eccentrically provided at the top of the shower head 1; and the shower head 1 comprises a water outlet disc 111, a housing 112, a water diversion mechanism 11 and a knob 15.

Figure 9:
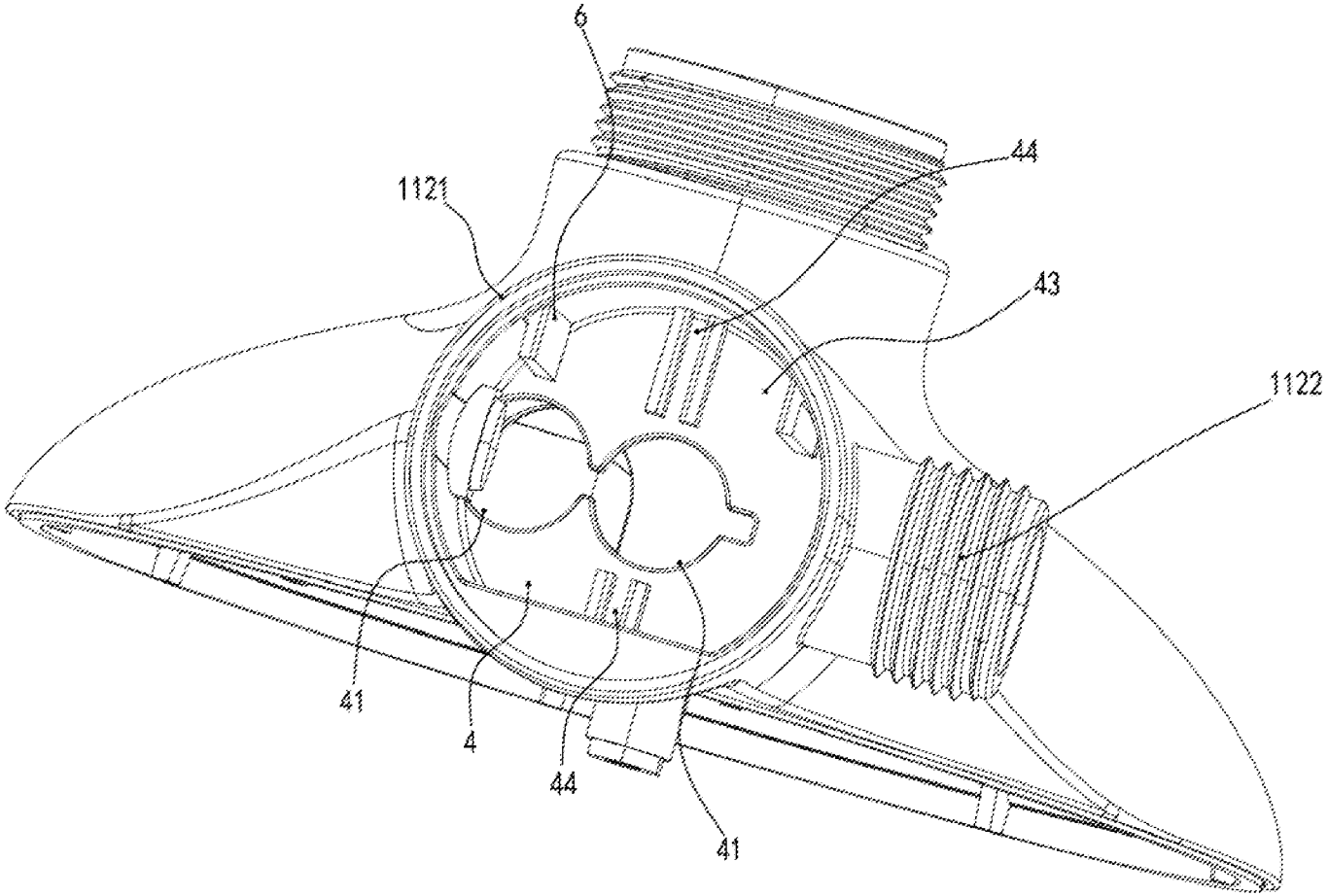
FIG. 9 is a schematic structural diagram of a housing according to the present invention.

As shown in FIG. 5 and FIG. 9, a handle 1121 extends horizontally on one side of the housing 112, a socket 7 for holding a handheld shower 8 is connected to the axial end of the handle 1121, the socket 7 can be fixedly connected to the end of the handle 1121, and the end of the handle 1121 can also be rotatably provided, that is, the angle of the socket 7 can be adjusted clockwise or counterclockwise with respect to the circumferential direction of the handle 1121; a water outlet 1122 is provided on the radial end of the handle 1121, and a partition wall 4 is provided in the inner chamber of the handle 1121; two mounting holes 41 are provided on the partition wall 4 in parallel, and a slot 44 is correspondingly provided at the upper and lower sides of the end surface at the side of the partition wall 4 facing the socket 7, respectively; at the same time, a water inlet 2 is provided eccentrically at the top of the housing 112 on a side close to the handle 1121.

Figure 8:
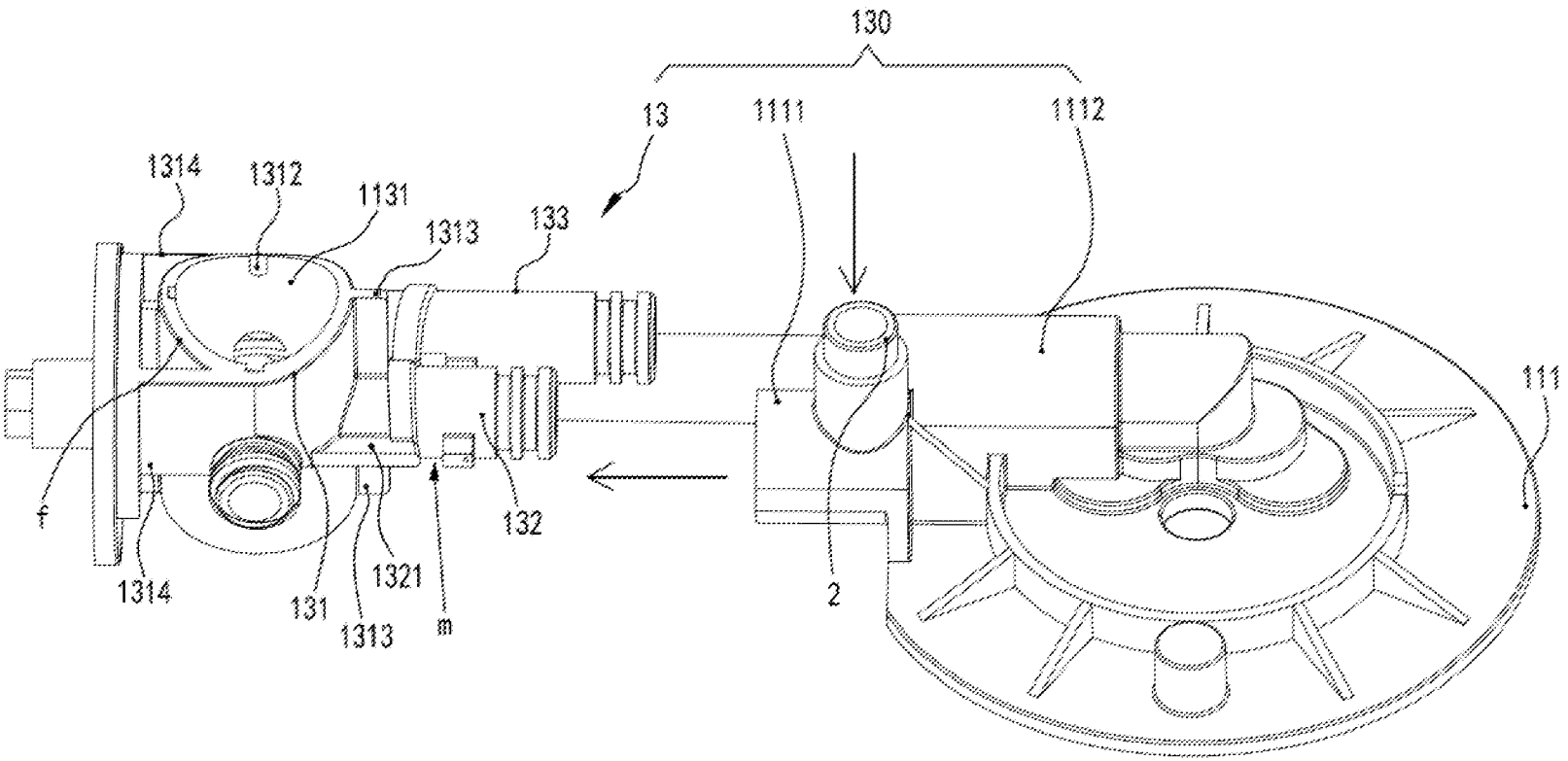
FIG. 8 is a cooperation diagram of a water diversion device and a water outlet disc according to the present invention.

As shown in FIG. 8, the water diversion mechanism 11 is provided in the inner chamber of the handle 1121. The water diversion mechanism 11 comprises a valve seat 130 and a valve core 14. The valve seat 130 comprises a first horizontal pipe 1111, a second horizontal pipe 1112 and a water diversion device 13, the first horizontal pipe 1111 and the second horizontal pipe 1112 are provided side by side inside the water outlet disc 111 horizontally, and the first horizontal pipe 1111 is communicated with the water inlet 2.

Figure 6:
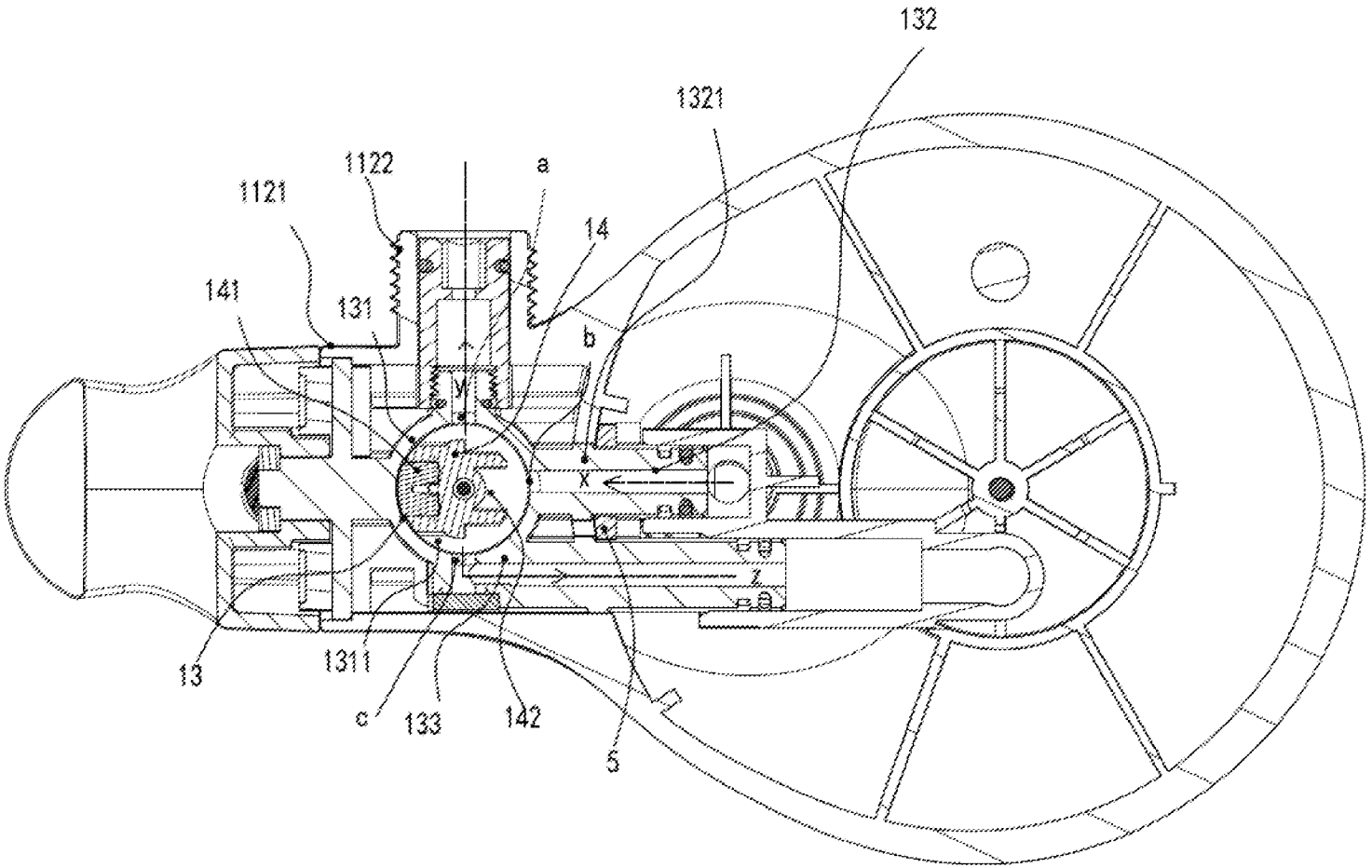
FIG. 6 is a cross-sectional diagram of a shower head with a socket according to the present invention.
Figure 7:
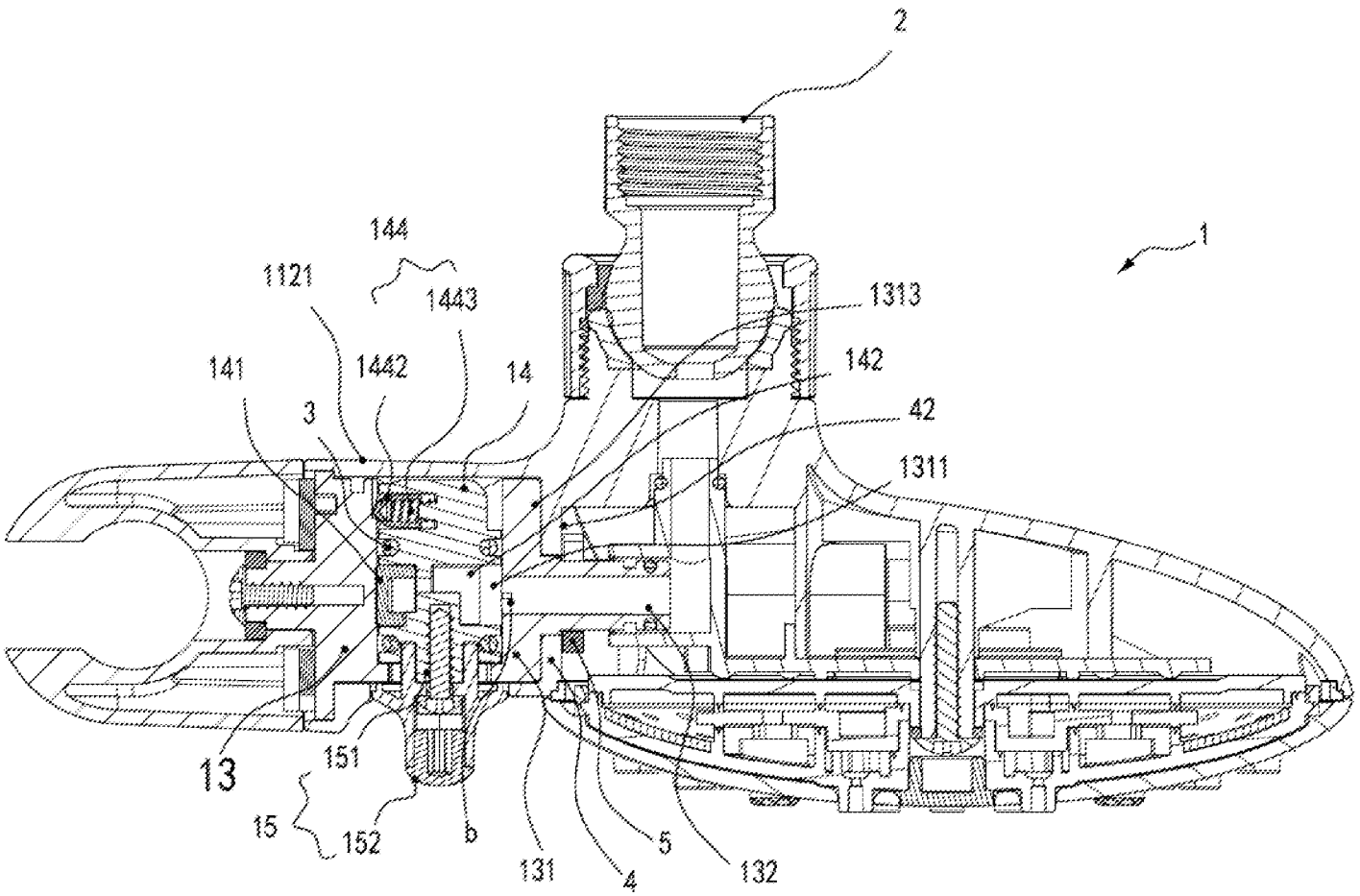
FIG. 7 is a longitudinal sectional diagram of a shower head with a socket according to the present invention.

As shown in FIG. 5, the water diversion device 13 has a water diversion member 131, a first water diversion pipe 132, and a second water diversion pipe 133, and the water diversion member 131 is provided perpendicularly to the first water diversion pipe 132 and the second water diversion pipe 133, respectively. An arc-shaped end surface f matching the inner top surface of the handle 1121 is provided at the top of the water diversion member 131, and a receiving chamber 1311 which is hollow in the upper part and the lower part is provided therein. As shown in FIG. 6, a first water outlet end a is provided in a side wall of the receiving chamber 1311; the first water diversion pipe 132 and the second water diversion pipe 133 are horizontally connected in parallel with the side wall of the water diversion member 131, and a first water inlet end b and a second water outlet end c are provided at the part connecting the first water diversion pipe 132 and the second water diversion pipe 133 with the receiving chamber 1311 of the water diversion member 131, respectively; as shown in FIG. 7 to FIG. 9, the free ends of the first water diversion pipe 132 and the second water diversion pipe 133 pass through the two mounting holes 41 of the partition wall 4 of the inner chamber of the handle 1121 and are inserted into the first horizontal pipe 1111 and the second horizontal pipe 1112 which are correspondingly provided, respectively; at the same time, in order to preventing the water diversion device 13 from generating axial horizontal displacement and circumferential rotation with respect to the handle 1121, two extension plates 1321 extend outward from both sides of the outer wall of the first water diversion pipe 132, the outer wall of the second water diversion pipe 133 is connected to an adjacent extension plate 1321; the two extension plates 1321 are provided with a bayonet m, respectively, a U-shaped ferrule 5 is embedded in two bayonets m with an opening upward, and both vertical sides of the U-shaped ferrule 5 are clamped to the outer side surface 42 of the partition wall 4; a plug board 1313 is provided at an upper and lower sides of the outer wall of the water diversion member 131 and at the position corresponding to the first water diversion pipe 132, respectively, the two plug boards 1313 and the two slots 44 of the partition wall 4 of the inner chamber of the handle 1121 are provided in one-to-one correspondence, and each of the plug boards 1313 is inserted into a corresponding slot 44. Further, two sticking plates 6 are vertically provided at the top of the inside of the handle 1121, the outer wall of the water diversion member 131 extends horizontally forward in the middle to form two positioning plates 1314, and the water diversion member 131 is clamped between the two sticking plates 6 by the two positioning plates 1314 to ensure that the water diversion device 13 can be firmly fixed in the inner chamber of the handle 1121 of the housing 112.

When the free ends of the first water diversion pipe 132 and the second water diversion pipe 133 are inserted into the first horizontal pipe 1111 and the second horizontal pipe 1112 which are correspondingly provided, respectively, the first water inlet end b, the first water diversion pipe 132, and the first horizontal pipe 1111 are communicated with the water inlet 2 to form the water inlet channel x; the first water outlet end a is communicated with the water outlet 1122 of the handle 1121 to form a first water outlet channel y; and the second water outlet end c and the second water diversion pipe 133 are communicated with the water outlet disc 111 to form the second water outlet channel z; at the same time, the water inlet channel x, the first water outlet channel y and the second water outlet channel z form a waterway pooling area in the receiving chamber 1311 of the water diversion member 131.

Refer to FIG. 5 and FIG. 10 again, the valve core 14 is rotatably provided in the receiving chamber 1311 of the water diversion member 131, the side of the valve core 14 is provided with a blocking member 141 and a water passage 142; the blocking member 141 comprises a sleeve 1411 and a rubber plug 1412 provided horizontally, the rubber plug 1412 is inserted into the sleeve 1411, the outer end of the rubber plug 1412 protrudes from the sleeve 1411, and the outer end surface 1413 of the rubber plug 1412 is an arc surface matching the inner wall of the receiving chamber 1311. The rubber plug 1412 has a certain elasticity, which can cooperate well with the sleeve 1411, can completely seal the first water inlet end b, the first water outlet end a or the second water outlet end c, and can also be completely attached to the inner wall of the receiving chamber 1311. The upper part and the lower part of the valve core 14 are provided with a sealing section 143, respectively, the blocking member 141 and the water passage 142 are both located between the two sealing sections 143; an outer wall of each sealing section 143 is annularly provided with a groove 1431, and a sealing ring 3 is embedded in the groove 1431. This design keeps the water sealed in the water passage 142 and will not leak to the upper part and the bottom of the valve core 14.

Figure 10:
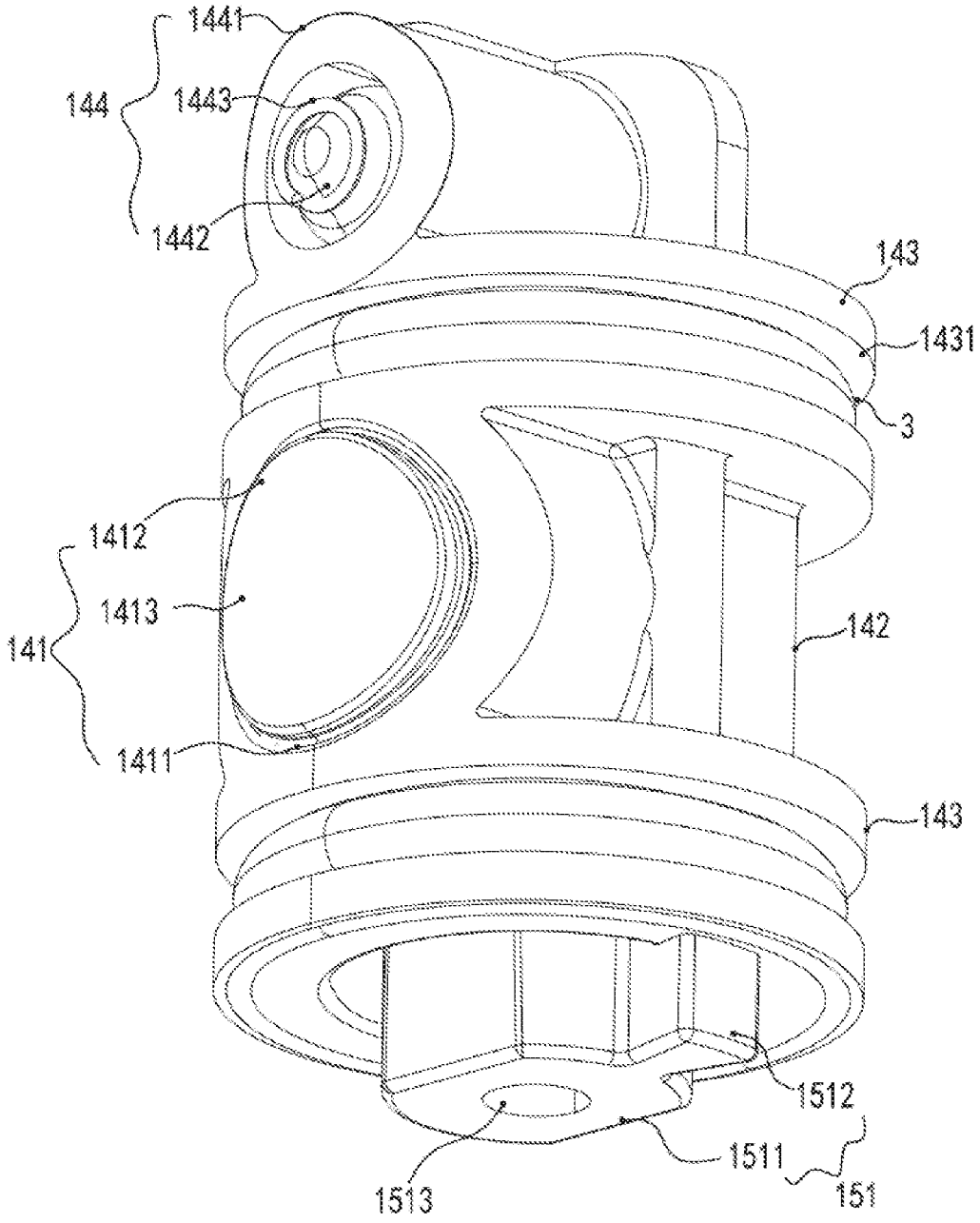
FIG. 10 is a schematic structural diagram of a valve core according to the present invention.
Figure 11:
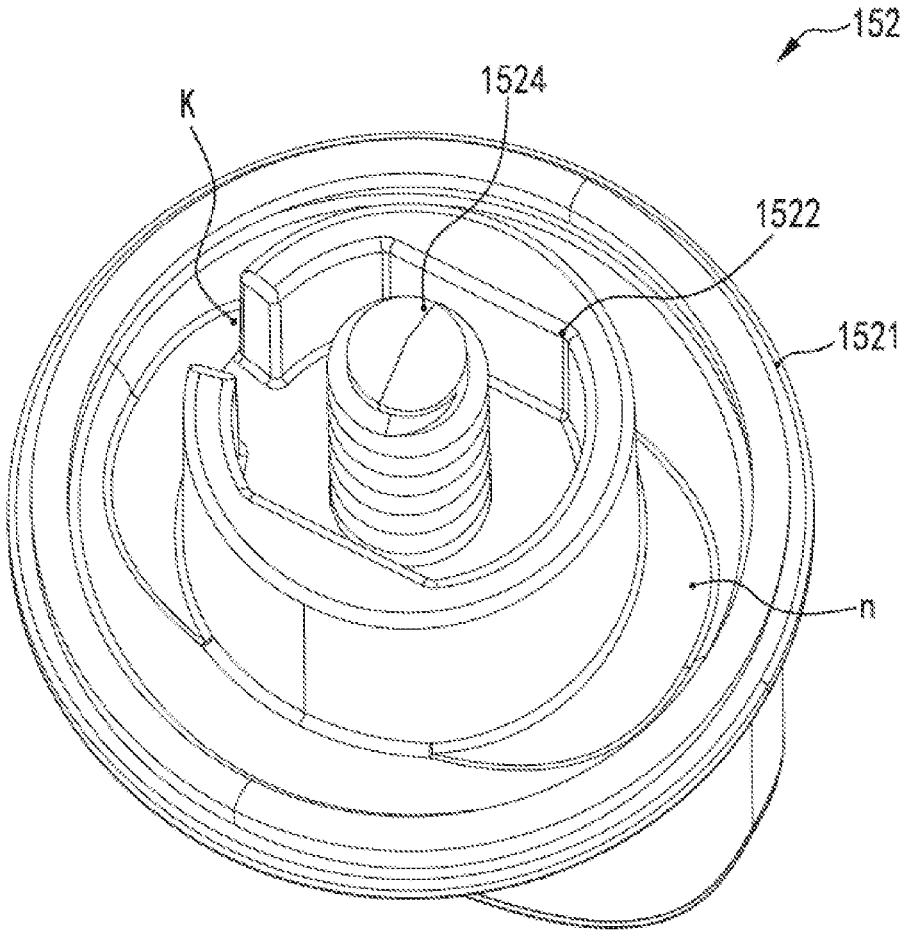
FIG. 11 is a schematic structural diagram of a rotary sleeve according to the present invention.

As shown in FIG. 10 and FIG. 7, the upper part of the valve core 14 is provided with a positioning component 144, the positioning component 144 is located above the sealing section 143, the positioning component 144 comprises a positioning cylinder 1441, a tapered positioning head 1442, and a first spring 1443, the positioning cylinder 1441 is sleeved on the tapered positioning head 1442; the tail of the tapered positioning head 1442 is a tapered head with an accommodation hole therein; one end of the first spring 1443 is abutted against the inner bottom surface of the positioning cylinder 1441, the other end is accommodated in the accommodation hole; the inner wall of the receiving chamber 1311 of the water diversion member 131 is provided with three positioning sticking points 1312 that match the tapered head at intervals, the three positioning sticking points 1312 are correspondingly provided above the side opposite to the first water inlet end b, the first water outlet end a and the second water outlet end c, respectively; and when the valve core 14 rotates, the tapered positioning head 1442 slides along the inner wall of the receiving chamber 1311 and is stuck in a positioning sticking point 1312; the sound generated when the tapered head of the tapered positioning head 1442 and the positioning sticking point 1312 are positioned is used to help people achieve accurate positioning.

As shown in FIG. 5, FIG. 7, FIG. 10, and FIG. 11, the knob 15 comprises a rotating core 151 and a rotating sleeve 152. The rotating core 151 is integrally connected to the bottom of the valve core 14. The rotating core 151 is connected with the rotating sleeve 152. The rotating sleeve 152 is connected to the bottom of the rotating core 151 and passes through the handle 1121, and the free end of the rotating sleeve 152 corresponds to the water outlet end surface of the water outlet disc 111. The rotating core 151 has a core body 1511 and a bayonet pin 1512 connected to an outer wall of the core body 1511. The core body 1511 is provided with a screw hole 1513; the rotating sleeve 152 comprises an outer housing 1521, an inner housing 1522 and a cock 1523. The upper part of the outer housing 1521 is a recess n matching the bottom of the water diversion piece 131, and the lower part thereof is a cavity matching the cock 1523. The recess n of the outer housing 1521 is sleeved at the bottom of the water diversion member 131, and the outer housing 1521 can be rotated with respect to the water diversion member 131. The cock 1523 is plugged into the cavity; the inner housing 1522 protrudes from the top of the outer housing 1521. The inner chamber of the inner housing 1522 is provided to match the core body 1511, and the side wall of the inner housing 1522 is disconnected to form a notch k that cooperates with the bayonet pin 1512. The inner housing 1522 is sleeved on the core body 1511, the bayonet pin 1512 is stuck in the notch k, and a screw 1524 passes through the inner housing 1522 and the screw hole 1513 of the core body 1511 from bottom to top in order to realize the connection between the rotating core 151 and the rotating sleeve 152.

The working principle of the waterway switching of the present invention is shown in FIGS. 6-7. When the knob 15 is turned, the valve core 14 is also rotated, and the blocking member 141 is abutted against different parts. When the blocking member 141 is abutted against the inner wall of the receiving chamber 1311, the first water diversion pipe 132, the second water diversion pipe 133, and the first water outlet end a are all in a connected state. Water flows from the water inlet 2 into the first horizontal pipe 1111, then flows into the first water diversion pipe 132, then flows into the second water diversion pipe 133 and the first water outlet end a at the same time, and flows from the first water outlet end a into the handheld shower 8 through a hose, and water also comes from the shower head 1 at the same time; when the blocking member 141 is abutted against the first water outlet end a, water flows from the first water diversion pipe 132 to the second water diversion pipe 133, and water only comes from the shower head 1; when the blocking member 141 is abutted against the second water diversion end c, the water flows from the first water diversion pipe 132 to the first water diversion end a, and water only comes from the handheld shower 8; when the blocking member 141 is abutted against the first water inlet end b, water neither comes from the shower head 1 nor comes from the handheld shower 8.

With the above structure, because the socket 7 and the shower head 8 are provided along the left and right sides of the handle 1121 of the housing, respectively, and at the same time, the water inlet 2 at the top of the housing 112 of the shower head 8 is provided adjacent to the handle 1121, that is, the water inlet 2 is eccentrically designed with respect to the shower head 8, the center of gravity of the overall shower component (the shower head 1+the handheld shower 8) is closer to the extension line of the water inlet 2 of the housing 112, which can prevent the shower component from deflecting toward the side of the handheld shower 8 when the handheld shower 8 is placed on the socket 7; and because the socket 7 is provided on the same side of the water outlet end surface of the shower head 8, it is convenient for the people to take and place the handheld shower 8; at the same time, the waterway switching knob 15 is also provided on the water outlet end surface of the shower head 8, which is convenient for the people to switch the waterway of the shower head 1 or the handheld shower 8.

The above description merely relates to embodiments of the present disclosure, and is not intended to limit the design of the present disclosure. Any equivalent changes made according to key points of the design of the present disclosure will fall within the scope of protection of the present disclosure.

What is claimed is:

1. A shower head with a holder device, comprising a housing, a water outlet disc, a water inlet and a water diversion mechanism, wherein: a handle extends horizontally on one side of the housing, at least a water outlet is provided on a radial end of the handle, and a socket for holding a handheld shower is connected to an axial end of the handle;

the water inlet is provided at a top of the housing on a side close to the handle;

the water diversion mechanism is provided inside the handle, the water diversion mechanism comprises a valve seat and a valve core; the valve seat has a water inlet channel (x), a first water outlet channel (y) and a second water outlet channel (z) which are communicated with the water inlet, the first water outlet channel (y) and the water outlet are communicated with each other, the second water outlet channel (z) and the water outlet disc of the shower head are communicated with each other; the water inlet channel (x), the first water outlet channel (y) and the second water outlet channel (z) have a waterway pooling area, the valve core is provided in the waterway pooling area, a knob is fixedly connected to the end of the valve core, the knob is provided on an end surface of the handle facing a side of a user, and the valve core is driven to rotate by the knob so as to realize waterway switching arrangement of the water inlet channel (x), the first water outlet channel (y) and the second water outlet channel (z).

2. The shower head with a holder device according to claim 1, wherein the valve seat comprises a first horizontal pipe, a second horizontal pipe and a water diversion device, the first horizontal pipe and the second horizontal pipe are provided side by side inside the water outlet disc, and the first horizontal pipe is communicated with the water inlet;

the water diversion device comprises a water diversion member, a first water diversion pipe, and a second water diversion pipe, the water diversion member is vertically provided and a receiving chamber which is hollow in the upper part and the lower part is provided therein, a first water outlet end (a) is provided in a side wall of the water diversion member; the first water diversion pipe and the second water diversion pipe are horizontally connected in parallel with the side wall of the water diversion member, a first water inlet end (b) and a second water outlet end (c) are provided at the part connecting the first water diversion pipe and the second water diversion pipe with the receiving chamber of the water diversion member, respectively; the free end of the first water diversion pipe is inserted into the first horizontal pipe, the free end of the second water diversion pipe is inserted into the second horizontal pipe; the first water inlet end (b), the first water diversion pipe, and the first horizontal pipe are communicated with the water inlet to form the water inlet channel (x); the first water outlet end (a) is communicated with the water outlet of the handle to form a first water outlet channel (y); and the second water outlet end (c) and the second water diversion pipe are communicated with the water outlet disc to form the second water outlet channel (z).

3. The shower head with a holder device according to claim 2, wherein the valve core is rotatably provided in the receiving chamber of the water diversion member, the side of the valve core is provided with a blocking member and a water passage; the blocking member is configured to block the first water inlet end (b) or the first water outlet end (a) or the second water outlet end (c); when the blocking member blocks the first water inlet end (b), the shower head realizes the water stopping function; when the blocking member blocks the first water outlet end (a), the water inlet channel (x) is communicated with the second water outlet channel (z) through the water passage; when the second water outlet end (c) is blocked by the blocking member, the water inlet channel (x) is communicated with the first water outlet channel (y) through the water passage; and when the blocking member is located on the inner wall of the receiving chamber of the water diversion member, the water inlet channel (x) is communicated with the first water outlet channel (y) and the second water outlet channel (z) through the water passage simultaneously.

4. The shower head with a holder device according to claim 3, wherein the upper part and the lower part of the valve core are provided with a sealing section, respectively, the blocking member and the water passage are both located between the two sealing sections; an outer wall of each sealing section is annularly provided with a groove, and a sealing ring is embedded in the groove.

5. The shower head with a holder device according to claim 4, wherein the upper part of the valve core is provided with a positioning component, the positioning component is located above the sealing section, the positioning component comprises a positioning cylinder, a tapered positioning head, and a first spring, the positioning cylinder is sleeved on the tapered positioning head; the tail of the tapered positioning head is a tapered head with an accommodation hole therein; one end of the first spring is abutted against the inner bottom surface of the positioning cylinder, the other end is accommodated in the accommodation hole; the inner wall of the receiving chamber of the water diversion member is provided with three positioning sticking points that match the tapered head at intervals, the three positioning sticking points are correspondingly provided above the side opposite to the first water inlet end (b), the first water outlet end (a) and the second water outlet end (c), respectively; and when the valve core rotates, the tapered positioning head slides along the inner wall of the receiving chamber and is stuck in a positioning sticking point.

6. The shower head with a holder device according to claim 3, wherein the blocking member comprises a sleeve and a rubber plug provided horizontally, the rubber plug is inserted into the sleeve, the outer end of the rubber plug protrudes from the sleeve, and the outer end surface of the rubber plug is an arc surface matching the inner wall of the receiving chamber.

7. The shower head with a holder device according to claim 2, wherein: a partition wall is provided inside the handle, two mounting holes are provided on the partition wall in parallel, the two mounting holes are matched with the first water diversion pipe and the second water diversion pipe, respectively, an arc-shaped end surface (f) matching the inner top surface of the handle is provided at the top of the water diversion member; the first water diversion pipe and the second water diversion pipe pass through the two mounting holes, respectively, the water diversion member is located inside the handle, and the arc-shaped end surface (f) of the water diversion piece is abutted against the inner top surface of the handle.

8. The shower head with a holder device according to claim 7, wherein: two extension plates extend outward from both sides of the outer wall of the first water diversion pipe, the outer wall of the second water diversion pipe is connected to an adjacent extension plate; the two extension plates are provided with a bayonet (m), respectively, a U-shaped ferrule is embedded in two bayonets (m) with an opening upward, and both vertical sides of the U-shaped ferrule are clamped to the outer side surface of the partition wall;

a plug board is provided at an upper and lower sides of the outer wall of the water diversion member and at the position corresponding to the first water diversion pipe, respectively, a slot is correspondingly provided at the upper and lower sides of the inner side surface of the partition wall, respectively, the two plug boards and the two slots are provided in one-to-one correspondence, and each of the plug boards is inserted into a corresponding slot.

9. The shower head with a holder device according to claim 7, wherein: two sticking plates are vertically provided at the top of the inside of the handle, the outer wall of the water diversion member extends horizontally forward in the middle to form two positioning plates, and the water diversion member is clamped between the two sticking plates by the two positioning plates.

10. The shower head with a holder device according to claim 1, wherein: the socket is rotatably provided at the end of the handle.

* * * * *